US008595885B1

(12) United States Patent
Weinstein

(10) Patent No.: US 8,595,885 B1
(45) Date of Patent: Dec. 3, 2013

(54) PET HAIR AND HUMAN HAIR GROOMING BRUSH WITH TWO SETS OF DIFFERENT BRISTLES

(76) Inventor: Ronald S. Weinstein, Chatsworth, CA (US)

( * ) Notice: Subject to any disclaimer, the term of this patent is extended or adjusted under 35 U.S.C. 154(b) by 826 days.

(21) Appl. No.: 12/655,666

(22) Filed: Jan. 5, 2010

(51) Int. Cl.
*A46B 9/02* (2006.01)
*A46B 9/06* (2006.01)

(52) U.S. Cl.
USPC ..... 15/160; 15/106; 15/186; 15/DIG. 6; D4/133; D4/134; 132/142; 119/612

(58) Field of Classification Search
USPC ..... 15/106, 159.1, 160, 201, 186, DIG. 6; 132/120, 121, 138, 142, 148, 150; D4/130, 132–134, 136; 119/612
See application file for complete search history.

(56) References Cited

U.S. PATENT DOCUMENTS

| | | | | | |
|---|---|---|---|---|---|
| 1,957,363 | A | * | 5/1934 | Snell | 15/191.1 |
| 3,133,546 | A | * | 5/1964 | Dent | 132/120 |
| 5,301,695 | A | * | 4/1994 | Wong | 132/108 |
| D466,697 | S | * | 12/2002 | Chen | D4/129 |
| D504,571 | S | * | 5/2005 | Kuo et al. | D4/133 |
| D504,572 | S | * | 5/2005 | Kuo et al. | D4/133 |
| D504,776 | S | * | 5/2005 | Kuo et al. | D4/133 |
| D544,715 | S | * | 6/2007 | White et al. | D4/133 |
| 2008/0149124 | A1 | * | 6/2008 | McKay | 132/116 |

FOREIGN PATENT DOCUMENTS

| | | | |
|---|---|---|---|
| BE | 1007329 | A6 * | 5/1995 |
| GB | 2447692 | A * | 9/2008 |

OTHER PUBLICATIONS

BE 1007329 A6 (Abstract), May 16, 1995.*

* cited by examiner

*Primary Examiner* — Mark Spisich
*Assistant Examiner* — Andrew A Horton
(74) *Attorney, Agent, or Firm* — Thomas I. Rozsa

(57) ABSTRACT

A multi-pin grooming brush having multi-sectioned bristles on the brush pad to provide a triple combing action. The brush has an outer layer of fixed pin tufts which encircle the exterior of the brush pad and preferably are metal pin tufts. The brush has a middle layer of flexible tufts preferably made of pure boar bristles and which are surrounded by the fixed pin tufts. As the brush is moved through a pet's hair or human hair, the outer layer of fixed pin tufts gently yet thoroughly detangles the coat, removes larger particles and provides a gentle massage effect, then the middle layer of pure boar bristles conditions the hair by distributing natural oils, leaving a healthy shine and a protective layer over the pet's coat, and then the opposite section of fixed pin tufts passes through the hair once again to smooth and separate the conditioned hair.

6 Claims, 5 Drawing Sheets

PET HAIR AND HUMAN HAIR GROOMING BRUSH WITH TWO SETS OF DIFFERENT BRISTLES

FIELD OF THE INVENTION

The present invention relates to the field of brushes which are used to comb and groom hair on pets such as dogs and cats and also can brush human hair.

DESCRIPTION OF THE PRIOR ART

In general, brushes used to groom the hair of dogs and cats and humans have been known in the prior art. However, to the best of the present inventor's knowledge, no-one has conceived of a dual pin grooming brush which provides improved beneficial effects when grooming a dog or cat or when combining human hair. There is a significant need for such an improved brush,

SUMMARY OF THE INVENTION

The present invention is a multi-pin grooming brush having multi-sectioned bristles on the brush pad to provide a triple combing action. The brush has an outer layer of fixed pin tufts which preferably are metal pin tufts which extend around the outer circumference of the brush and extend inwardly to form an outer ring of fixed pin tufts. The brush further has a middle layer of pure boar bristles which are surrounded by the ring of fixed pin tufts. Brushing is performed with a horizontal motion of the brush through the hair. As the brush is moved through a pet's hair or human hair, the first outer section of metal pin tufts gently yet thoroughly detangles the coat, removes larger particles and provides a gentle massage effect. As the brush is continued through the pet's coat or person's hair, the middle layer of pure boar bristles conditions the hair by distributing natural oils, leaving a healthy shine and a protective layer over the pet's coat or person's hair. Continuing the horizontal motion the brush then goes through the opposite outer section of fixed pin tufts. As the brush is moved through the pet's coat or person's hair, the outer layer of fixed pin tufts passes through the hair once again to smooth and separate the conditioned hair. The brush perform a three-in-one brush stroke to provide a clean, healthy and luxurious coat for the dog or cat or human hair.

It is an object of the present invention to provide a hair brush for pet hair and human hair comprising: (a) a support base which retains a brush pad which has a center area and a circumference adjacent the support base; (b) a multiplicity of fixed pin tufts retained in the brush pad, the fixed pin tufts having a stem, the multiplicity of fixed pin tufts extending inwardly toward the center of the pad in a ring around the brush pad from a location adjacent the pad circumference; and © a multiplicity of flexible tufts having a stem and retained in the center area of the brush pad and surrounded by the fixed pin tufts so that in a brushing action, a first outer section of the fixed pin tufts enter the hair first, next the flexible tufts enter the hair and then an opposite outer section of fixed pin tufts enter the hair.

The above embodiment can also be incorporated into a two sided brush.

It is also an object of the present invention to provide a brush where the flexible tufts are on the exterior ring and the fixed pin tufts are in the center area of the pad and surrounded by the flexible tufts.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
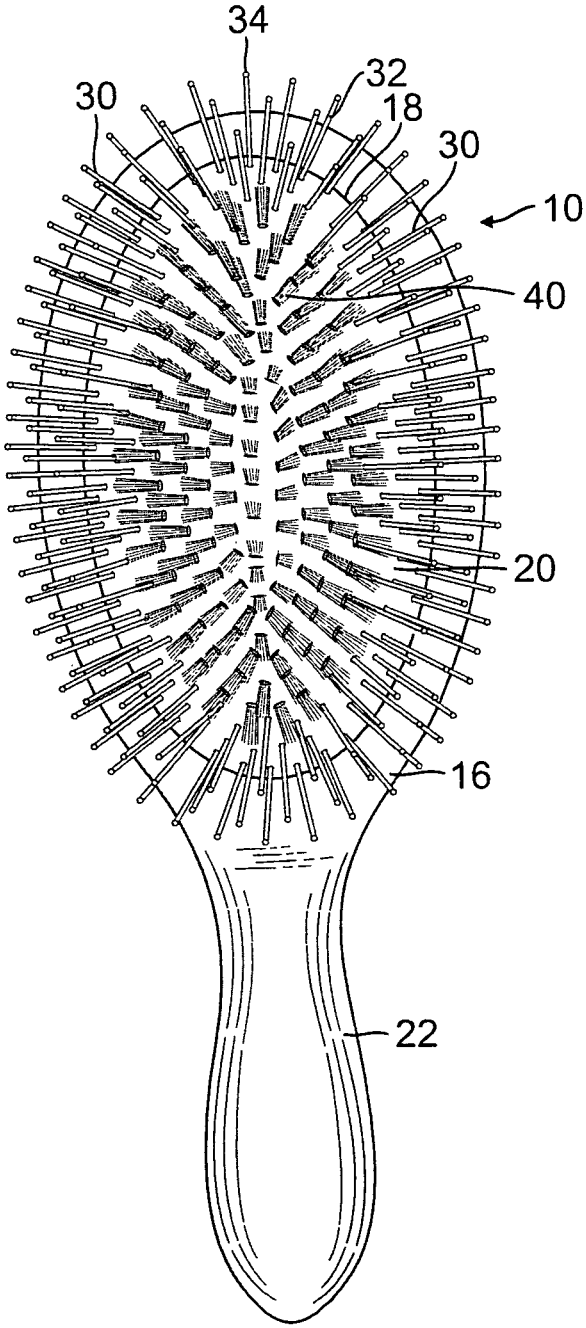
FIG. 1 is a top plan view of the present invention multi-sectioned bristle brush for grooming the hair of dogs and cats (or humans), where the bristles are on one side of the brush pad.
Figure 2:
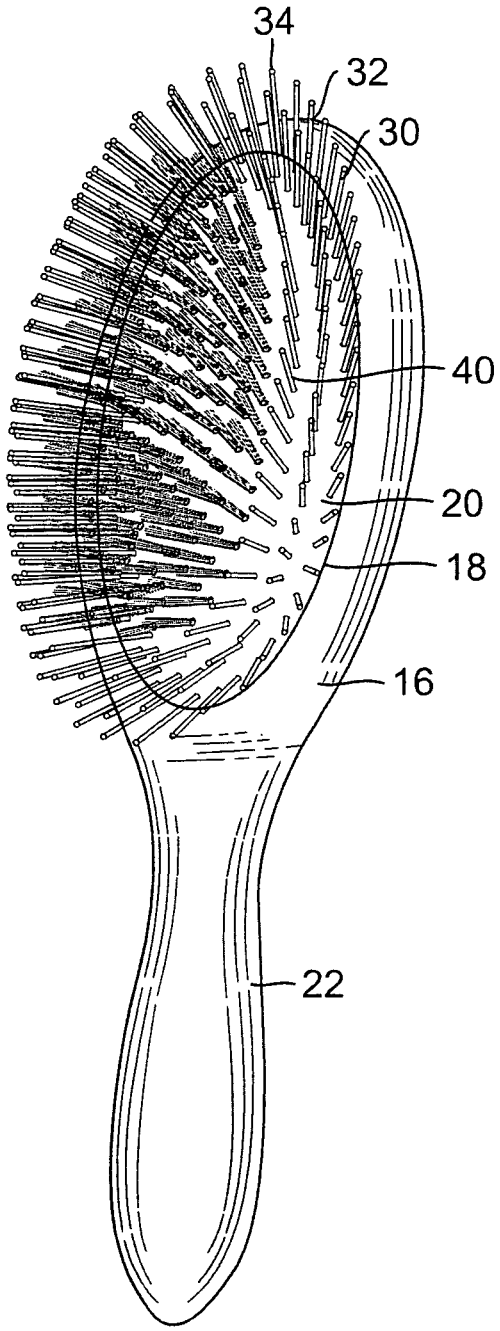
FIG. 2 is a side-perspective view of the present invention multi-sectioned bristle brush for grooming the hair of dogs and cats (or humans), where the bristles are on one side of the brush pad.

Referring to FIGS. 1 and 2, there is illustrated a preferred embodiment of the present invention. The pet hair grooming brush 10 has a support base 16 which retains and supports a brush pad 20. The pad 20 has a circumference 18 adjacent support base 16. The support base 16 may have a handle 22 by which the brush 10 is held when in use. Alternatively, the support base may have a strap on the back of the base 16 so that the hand is placed between the strap and the support base 16 when the brush 10 is used. The handle 16 or strap are referred to as brush retaining means.

The exterior section row of tufts extending from adjacent to circumference 18 inwardly toward the center of the pad is made fixed pin tufts 30 and can be made of metal, wire, nylon or wood. Each pin tuft 30 has an elongated stem 32 and ends in a rounded tip 34. Each fixed pin tuft 30 is retained in the pad 20. The illustration shows three rows of fixed pin tufts 30 but it is within the spirit and scope of the present invention to have at least one row of fixed pin tufts and/or any desired number of rows of fixed pin tufts. In general, three (3) rows of fixed pin tufts is the preferred embodiment. The preferred fixed pin tuft 30 is made of metal and in particular steel, but other wire can also be used. In addition, the fixed pin tuft 30 can be made of wood or nylon or other rigid material. The rounded tip 34 is preferred in order not to scratch the animal's skin. The fixed pin tufts in one row can be aligned with the fixed pin tufts in an adjacent row or the fixed pin tufts in one row can be offset from the fixed pin tufts in an adjacent row. The fixed pin tufts 30 extend in a ring around the brush pad from an area adjacent the circumference 18 inwardly around the entire outer area of the brush pad 20.

The interior section of the brush pad 20 is comprised of flexible bristle tufts 40. The flexible bristle tufts can be made of real boar bristle, flexible nylon bristles, and natural bristles. The illustration shows seven rows of flexible bristle pin tufts 40 but it is within the spirit and scope of the present invention to have at least one row of flexible bristle tufts and/or any desired number of rows of flexible bristle tufts. In general, seven (7) rows of flexible bristle tufts is the preferred embodiment. The preferred flexible bristle 40 is made of real boar bristle. In addition, the flexible bristle tuft 40 can be made of flexible nylon or other flexible bristle material. Each flexible bristle tuft is retained in the brush pad 20. The flexible bristle tufts in one row can be aligned with the flexible bristle tufts in an adjacent row or the flexible bristle tufts in one row can be offset from the flexible bristle tufts in an adjacent row. The flexible bristle tufts 40 are located in the central area of the brush pad 20 and are surrounded by the outer ring of fixed pin tufts 30.

The present invention multi-section bristle brush provides unique benefits of triple combing action. The special sectioned tufting pattern actually acts like three brush strokes in one. The motion is a horizontal motion of the brush 10 so that the hair encounters the fixed pin tufts 30 on one side of the brush first, then the flexible tufts 40 and then the opposite section of fixed pin tufts 30. As you brush your pet's coat with the pet grooming brush 10, the outer layer of fixed pin tufts 30 gently yet throughly detangles the coat, removes larger particles, and provides a gentle massage effect. Next, the middle layer of flexible bristle tufts 40 such as pure boar bristle tufts 40 conditions the hair by distributing natural oils, leaving a healthy shine and a protective layer over the pet's coat. Finally, the opposite outer layer of fixed pin tufts 30 passes through the hair once again to smooth and separate the conditioned hair. The final result is a clean, healthy and luxurious coat that other brushes simply cannot provide.

Figure 3:
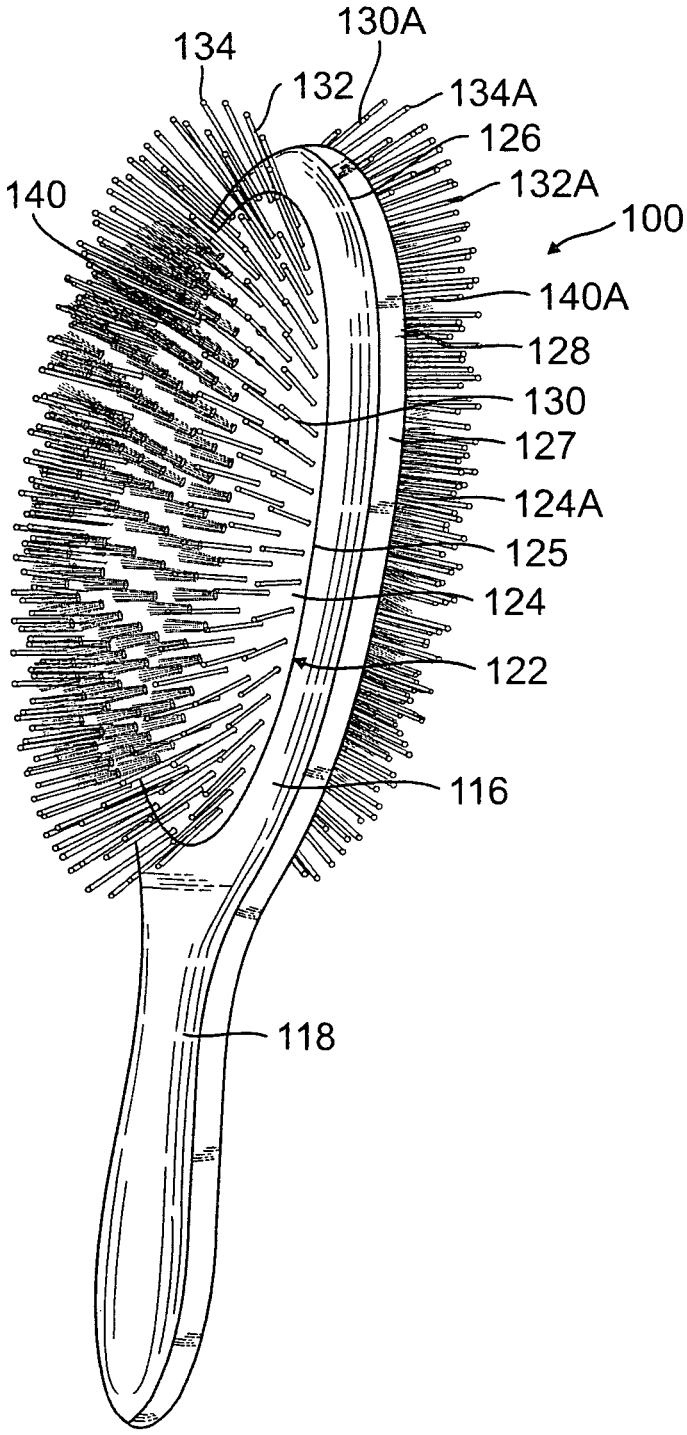
FIG. 3 is a side-perspective view of the present invention multi-sectioned bristle brush for grooming the hair of dogs and cats (or humans), where the bristles are on both sides of the brush pad.

In an alternative embodiment illustrated in FIG. 3, the sets of fixed pin tufts and flexible bristle tufts extend from the front and back face of the brush. The pet grooming hair brush 100 has a support base 116 with a front face 122 which supports a first brush pad 124 and a back face 126 which supports a second brush pad 128. The support base 116 may have a handle 118 by which the brush 100 is held when in use. The pad 124 has a circumference 125 adjacent the support base 116. The pad 128 has a circumference 127 adjacent the support base 116.

On the front face 122 and supported within the first brush pad 124, the exterior section row of tufts extending inwardly from adjacent the circumference is made fixed pin tufts 130 and can be made of metal, wire, nylon or wood. Each fixed pin tuft 130 has an elongated stem 132 and ends in a rounded tip 134. Each fixed pin tuft 130 is retained in the first brush pad 124. The illustration shows three rows of fixed pin tufts 130 but it is within the spirit and scope of the present invention to have at least one row of fixed pin tufts and/or any desired number of rows of fixed pin tufts. In general, three (3) rows of fixed pin tufts is the preferred embodiment. The preferred fixed pin tuft 130 is made of metal and in particular steel, but other wire can also be used. In addition, the fixed pin tuft 130 can be made of wood or nylon or other rigid material. The rounded tip 134 is preferred in order not to scratch the animal's skin. The fixed pin tufts in one row can be aligned with the fixed pin tufts in an adjacent row or the fixed pin tufts in one row can be offset from the fixed pin tufts in an adjacent row. The fixed pin tufts 130 extend in a ring around the brush pad from an area adjacent the circumference 118 inwardly around the entire outer area of the brush pad 120.

The interior section of the brush 100 is comprised of flexible bristle tufts 140. The flexible bristle tufts can be made of real boar bristle, flexible nylon bristles, and natural bristles. The illustration shows seven rows of flexible bristle pin tufts 140 but it is within the spirit and scope of the present invention to have at least one row of flexible bristle tufts and/or any desired number of rows of flexible bristle tufts. In general, seven (7) rows of flexible bristle tufts is the preferred embodiment. The preferred flexible bristle 140 is made of real boar bristle. In addition, the flexible bristle tuft 140 can be made of flexible nylon or other flexible bristle material. Each flexible bristle tuft is retained in the first brush pad 124. The flexible bristle tufts in one row can be aligned with the flexible bristle tufts in an adjacent row or the flexible bristle tufts in one row can be offset from the flexible bristle tufts in an adjacent row. The flexible bristle tufts 140 are in the center area of the pad 120 and are surrounded by the fixed pin tufts 130.

On the rear face 126 and supported within the second brush pad 128, the exterior section row of tufts is made fixed pin tufts 130A and can be made of metal, wire, nylon or wood. Each pin tuft 130A has an elongated stem 132A and ends in a rounded tip 134A. Each fixed pin tuft 130A is retained in the first brush pad 124A. The illustration shows three rows of fixed pin tufts 130A but it is within the spirit and scope of the present invention to have at least one row of fixed pin tufts and/or any desired number of rows of fixed pin tufts. In general, three (3) rows of fixed pin tufts is the preferred embodiment. The preferred fixed pin tuft 130A is made of metal and in particular steel, but other wire can also be used. In addition, the fixed pin tuft 130A can be made of wood or nylon or other rigid material. The rounded tip 134A is preferred in order not to scratch the animal's skin. The fixed pin tufts in one row can be aligned with the fixed pin tufts in an adjacent row or the fixed pin tufts in one row can be offset from the fixed pin tufts in an adjacent row. The fixed pin tufts 130A are in an exterior ring extending from the circumference 127 inwardly.

The interior section of the brush 100 at the center area of the pad 128 is comprised of flexible bristle tufts 140A. The flexible bristle tufts can be made of real boar bristle, flexible nylon bristles, and natural bristles. The illustration shows seven rows of flexible bristle pin tufts 140A but it is within the spirit and scope of the present invention to have at least one row of flexible bristle tufts and/or any desired number of rows of flexible bristle tufts. In general, seven (7) rows of flexible bristle tufts is the preferred embodiment. The preferred flexible bristle 140A is made of real boar bristle. In addition, the flexible bristle tuft 140A can be made of flexible nylon or other flexible bristle material. Each flexible bristle tuft is retained in the second brush pad 128. The flexible bristle tufts in one row can be aligned with the flexible bristle tufts in an adjacent row or the flexible bristle tufts in one row can be offset from the flexible bristle tufts in an adjacent row. The flexible bristle tufts 140A are in the center area of the pad 128 and are surrounded by the fixed pin tufts 130A.

The present invention multi-section bristle brush provides unique benefits of triple combing action. The special sectioned tufting pattern actually acts like three brush strokes in one. The brushing action is horizontally along the tufts using either side of the brush 100. As you brush your pet's coat with the pet grooming brush 100, the outer layer of metal pin tufts 130 or 130A gently yet thoroughly detangles the coat, removes larger particles, and provides a gentle massage effect. Next, the middle layer of flexible bristle tufts 140 or 140A such as pure boar bristle tufts 140 or 140A conditions the hair by distributing natural oils, leaving a healthy shine and a protective layer over the pet's coat. Finally, the opposite outer layer of fixed pin tufts 130 or 130A passes through the hair once again to smooth and separate the conditioned hair. The final result is a clean, healthy and luxurious coat that other brushes simply cannot provide.

Figure 4:
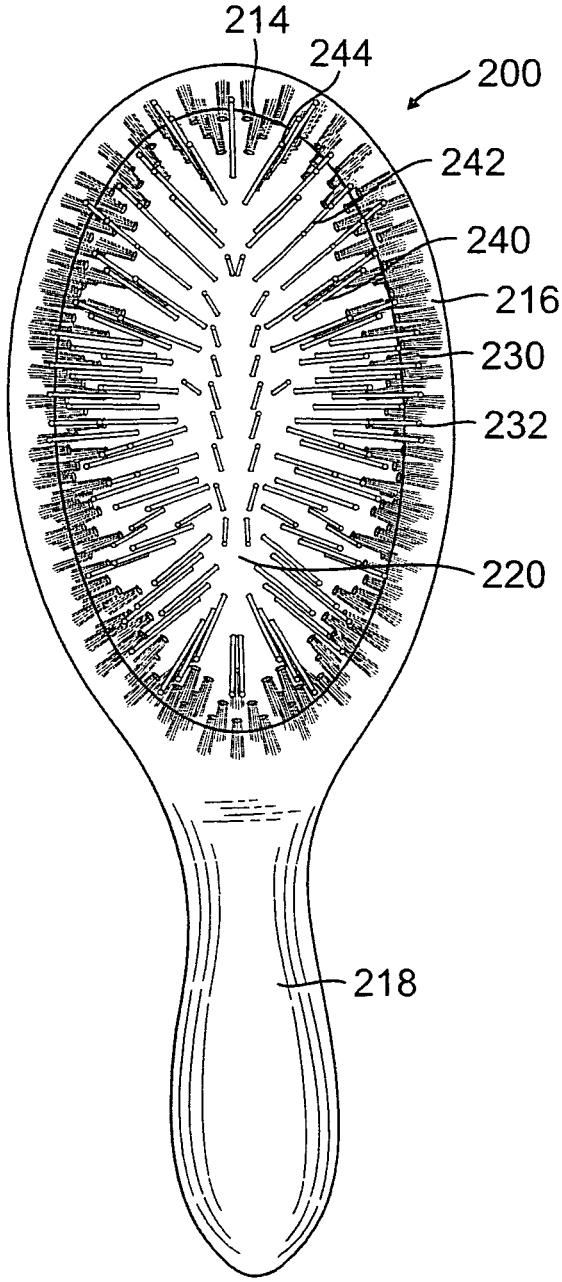
FIG. 4 is a top plan view of a first alternative embodiment of the present invention multi-sectioned bristle brush for grooming the hair of dogs and cats (or humans), where the bristles are on one side of the brush pad.

A second alternative embodiment of the present invention is illustrated in FIG. 4. The pet hair grooming brush 200 has a support base 216 which retains and supports a brush pad 220 The support base 216 may have a handle 218 by which the brush 200 is held when in use. The pad 216 has a circumference 214 adjacent the support base 216. Alternatively, the support base may have a strap on the back of the base 216 so that the hand is placed between the strap and support base 216 when the brush 200 is used. The handle 216 or strap are referred to as retaining members.

In the second alternative embodiment 200, the flexible bristle tufts are on the outside and the fixed pin tufts are on the inside. Supported within the brush pad 224, the exterior section row of tufts is made flexible bristle tufts 230 and can be made of real boar bristle, flexible nylon bristles and natural bristles. Each flexible bristle tuft 230 has an elongated stem 232. Each flexible bristle tuft 230 is retained in the brush pad 220. The illustration shows three rows of flexible bristle tufts 230 but it is within the spirit and scope of the present invention to have at least one row of flexible bristle tufts and/or any desired number of rows of flexible bristle tufts. In general, three (3) rows of flexible bristle tufts is the preferred embodiment. The preferred flexible bristle tuft 230 is made of real boar bristle, but other flexible materials also be used. The flexible bristle tufts in one row can be aligned with the flexible pin tufts in an adjacent row or the flexible pin tufts in one row can be offset from the flexible pin tufts in an adjacent row. The flexible bristle tufts form a ring around the pad 220 extending inwardly from adjacent the circumference 214 of the pad 220.

The interior section of the brush 200 is comprised of fixed pin tufts 240 and can be made of metal, wire, nylon or wood. Each fixed pin tuft 240 has an elongated stem 242 and end in a rounded tip 244. Each fixed pin tuft 240 is retained in pad 220. The illustration shows seven rows of fixed pin tufts 240 but it is within the spirit and scope of the present invention to have at least one row of fixed pin tufts and/or any desired number of rows of fixed pin tufts. In general, seven (7) rows of fixed pin tufts is the preferred embodiment. The preferred fixed pin tuft 240 is made of metal. In addition, the fixed pin tuft 240 can be made of wire, wood or other hard material. The rounded tip 244 is used to prevent the pin from scratching the animal's skin. Each fixed pin tuft is retained in the brush pad 220. The fixed pin tufts in one row can be aligned with the fixed pin tufts in an adjacent row or the fixed pin tufts in one row can be offset from the fixed pin tufts in an adjacent row. The fixed pin tufts 240 are in the center area of the brush pad 220 and are surrounded by the flexible bristle tufts 230.

While shown on only one face, it is within the spirit and scope of the present invention to have the variation illustrated in FIG. 4 on both faces, as illustrated in FIG. 3.

Figure 5:
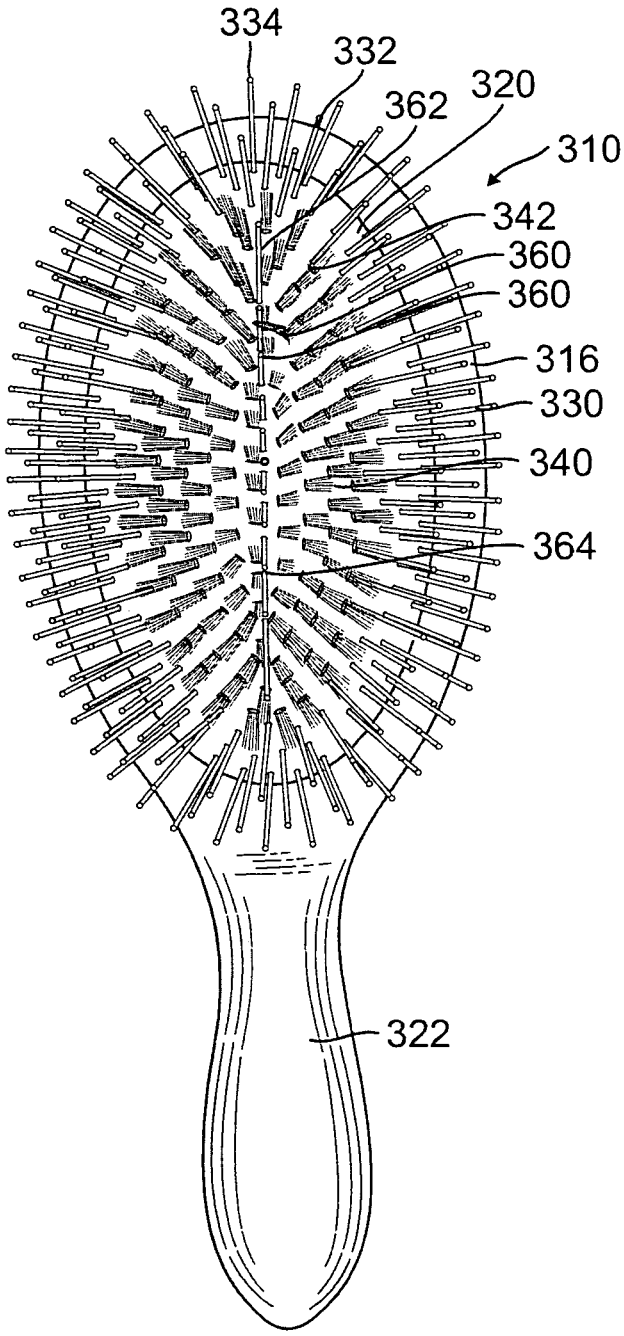
FIG. 5 is a top plan view of a second alternative embodiment of the present invention multi-sectioned bristle brush for grooming the hair of dogs and cats (or humans), where the bristles are on one side of the brush pad.

Another variation or third alternative embodiment of the present invention is illustrated in FIG. 5. This variation is the same as illustrated in FIGS. 1 and 2 but has the addition of incorporating a fixed pin tuft into one or more of the flexible bristle tufts.

Referring to FIG. 5, there is illustrated the third alternative embodiment of the present invention. The pet hair grooming brush 310 has a support base 316 which retains and supports a brush pad 320. The support base 316 may have a handle 322 by which the brush 310 is held when in use. Alternatively, the support base may have a strap on the back of the base 316 so that the hand is placed between the strap and the support base 316 when the brush 310 is used. The handle 322 or strap are referred to as retaining means.

The exterior section row of tufts is made fixed pin tufts 330 and can be made of metal, wire, nylon or wood. Each fixed pin tuft 330 has an elongated stem 332 and ends in a rounded tip 334. Each fixed pin tuft 330 is retained in the pad 320. The illustration shows three rows of fixed pin tufts 330 but it is within the spirit and scope of the present invention to have at least one row of fixed pin tufts and/or any desired number of rows of fixed pin tufts. In general, three (3) rows of fixed pin tufts is the preferred embodiment. The preferred fixed pin tuft 330 is made of metal and in particular steel, but other wire can also be used. In addition, the fixed pin tuft 330 can be made of wood or nylon or other rigid material. The rounded tip 334 is preferred in order not to scratch the animal's skin. The fixed pin tufts in one row can be aligned with the fixed pin tufts in an adjacent row or the fixed pin tufts in one row can be offset from the fixed pin tufts in an adjacent row. The fixed pin tufts 330 extend in a ring around the pad 320 and extend from adjacent the exterior circumference 316 inwardly.

The interior section of the brush pad 320 is comprised of flexible bristle tufts 340. The flexible bristle tufts can be made of real boar bristle, flexible nylon bristles, and natural bristles. The illustration shows seven rows of flexible bristle pin tufts 340 but it is within the spirit and scope of the present invention to have at least one row of flexible bristle tufts and/or any desired number of rows of flexible bristle tufts. In general, seven (7) rows of flexible bristle tufts is the preferred embodiment. The preferred flexible bristle 340 is made of real boar bristle. In addition, the flexible bristle tuft 340 can be made of flexible nylon or other flexible bristle material. Each flexible bristle tuft is retained in the brush pad 320. The flexible bristle tufts in one row can be aligned with the flexible bristle tufts in an adjacent row or the flexible bristle tufts in one row can be offset from the flexible bristle tufts in an adjacent row. The flexible bristle tufts 340 are in the center area of the brush pad 320 and are surrounded by the fixed pin tufts 330.

The variation is that incorporated into at least one, possibly all, and most commonly several of the flexible bristle tufts 340 is a fixed pin tuft 360. Each fixed pin tuft 360 has a stem 362 which extends into the stem 342 of the flexible bristle tuft 340. Each fixed pin tuft 360 has a rounded tip 364. Each fixed pin tuft can be made of metal, wood, hard nylon or other hard materials. Each fixed pin tuft 360 is retained in pad 320.

The present invention multi-section bristle brush provides unique benefits of triple combing action. The special sectioned tufting pattern actually acts like three brush strokes in one. As you brush your pet's coat with the pet grooming brush 310, the outer layer of fixed pin tufts 330 gently yet thoroughly detangles the coat, removes larger particles, and provides a gentle massage effect. Next, the middle layer of flexible bristle tufts 340 such as pure boar bristle tufts 340 with extra action by the incorporated fixed pin tufts 360 conditions the hair by distributing natural oils, leaving a healthy shine and a protective layer over the pet's coat. Finally, the opposite outer layer of fixed pin tufts 330 passes through the hair once again to smooth and separate the conditioned hair. The final result is a clean, healthy and luxurious coat that other brushes simply cannot provide.

While described primarily to brush a pet's hair, it will be appreciated that the present invention including all variations disclosed in FIGS. 1 through 5 can also be used to brush human hair.

The present invention is a hair brush comprising: (a) a support base which retains a brush pad which has a center area and a circumference adjacent the support base; (b) a multiplicity of fixed pin tufts retained in the brush pad, the fixed pin tufts having a stem, the multiplicity of fixed pin tufts extending inwardly toward the center of the pad in a ring around the brush pad from a location adjacent the pad circumference; and (c) a multiplicity of flexible tufts having a stem and retained in the center area of the brush pad and surrounded by the fixed pin tufts so that in a brushing action, a first outer section of the fixed pin tufts enter the hair first, next the flexible tufts enter the hair and then an opposite outer section of fixed pin tufts enter the hair.

Alternatively, the present invention is a hair brush comprising: (a) a support base which retains a brush pad which has a center area and a circumference adjacent the support base; (b) a multiplicity of flexible tufts retained in the brush pad, the flexible tufts having a stem, the multiplicity of flexible tufts extending inwardly toward the center of the pad in a ring around the brush pad from a location adjacent the pad circumference; and (c) a multiplicity of fixed pin tufts having a stem and retained in the center area of the brush pad and surrounded by the flexible tufts so that in a brushing action, a first outer section of the flexible tufts enter the hair first, next the fixed pin tufts enter the hair and then an opposite outer section of flexible tufts enter the hair.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A hair brush consisting of:

a. a support base which retains a brush pad which has a center area and an exterior circumference adjacent the support base;

b. a first outermost row of a multiplicity of outermost fixed pin tufts retained in the brush pad adjacent the exterior circumference and encircling the brush pad with each fixed pin tuft extending outwardly toward the exterior circumference and each outermost fixed pin tuft having a stem;

c. a first interior row of a multiplicity of fixed pin tufts retained in the brush pad and encircling the brush pad with each first interior row of fixed pin tufts interior to the outermost row fixed pin tufts and extending interior to and offset from a respective fixed pin tuft of the first outermost row of fixed pin tufts, and each fixed pin tuft of the first interior row of fixed pin tufts having a stem;

d. a second interior row of a multiplicity of fixed pin tufts retained in the brush pad and encircling the brush pad with each fixed pin tuft of the second interior row of fixed pin tufts interior of the first interior row of fixed pin tufts and extending interior to and offset from a respective first interior fixed pin tuft, and each fixed pin tuft of the second interior row of fixed pin tufts having a stem;

e. a multiplicity of flexible tufts having a stem and retained in the center area of the brush pad, the multiplicity of flexible tufts formed into a multiplicity of rows offset from each other and surrounding a center row of flexible tufts retained down a center of the brush pad; and f. when brushing hair, the first outermost row of fixed pin tufts enter the hair first followed by the first interior row of fixed pin tufts followed by the second interior row of fixed pin tufts, followed by the multiplicity of flexible tufts, followed by the second interior row of fixed pin tufts followed by the first interior row of fixed pin tufts followed by the outermost row of fixed pin tufts.

2. The hair brush in accordance with claim 1, further consisting of:

a respective one of the fixed pin tufts in the second interior row of fixed pin tufts are aligned with a respective one of the fixed pin tufts in the outermost row of fixed pin tufts.

3. The hair brush in accordance with claim 1 wherein the fixed pin tufts are made of material selected from the group consisting of metal, wire and nylon.

4. The hair brush in accordance with claim 1 wherein each fixed pin tuft of the outermost row of fixed pin tufts terminates in a rounded tip at a location remote from the brush pad.

5. The hair brush in accordance with claim 1 wherein each fixed pin tuft of the first innermost row of fixed pin tufts terminates in a rounded tip at a location remote from the brush pad.

6. The hair brush in accordance with claim 1 wherein each fixed pin tuft of the second innermost row of fixed pin tufts terminates in a rounded tip at a location remote from the brush pad.

* * * * *